United States Patent [19]

Taylor

[11] 4,210,014

[45] Jul. 1, 1980

[54] CABLE STRAIGHTENER

[76] Inventor: Robert K. Taylor, 1621 Moores Garden Rd., Mt. Vernon, Wash. 98273

[21] Appl. No.: 957,875

[22] Filed: Nov. 6, 1978

[51] Int. Cl.[2] ..... B21D 7/06

[52] U.S. Cl. ..... 72/389; 72/453.15

[58] Field of Search ..... 72/389, 387, 380, 453.15, 72/457, 458, 384

[56] References Cited

U.S. PATENT DOCUMENTS

| | | | |
|---|---|---|---|
| 630,484 | 8/1899 | Brown | 72/389 |
| 634,245 | 10/1899 | Muncaster | 72/389 |
| 1,026,916 | 5/1912 | Johnson | 72/389 |
| 2,360,171 | 10/1944 | Smith | 72/387 |
| 2,407,040 | 9/1946 | Taramashi | 72/389 |
| 3,209,577 | 10/1965 | Teplow | 72/389 |
| 3,421,356 | 1/1969 | Buske | 72/387 |
| 3,848,450 | 11/1974 | Dehlbom | 72/389 |

*Primary Examiner*—Francis S. Husar
*Assistant Examiner*—Gene P. Crosby
*Attorney, Agent, or Firm*—Dowrey & Cross

[57] ABSTRACT

An apparatus for straightening cables comprising cable support means for supporting a bent portion of a cable, jaw means and power actuation means for the jaw means. The jaw means is pivotally supported by the support means for movement to and away from a position in which it can bear against the bent cable portion. The apparatus includes pedal actuation means to allow two-handed manipulation of the cable during straightening.

8 Claims, 3 Drawing Figures

CABLE STRAIGHTENER

FIELD OF THE INVENTION

This invention relates to cable straightening devices.

BACKGROUND OF THE INVENTION

Prior cable straightening devices have included both manually actuated and power actuated types. Manual cable straighteners have the advantage of being comparatively simple in construction, but they require considerable strength to use, particularly on thick cable. Prior power operated cable straighteners, on the other hand, have generally been large and mechanically complex. Furthermore, prior power actuated devices have not been constructed so that the operator can use both hands to position the cable during operation of the device.

SUMMARY OF THE INVENTION

This invention provides a power actuated cable straightener which is simple in construction and easy to use, and which permits the operator to use both hands to position the cable during operation of the cable straightener. The cable straightener of this invention is particularly suited to field operation such as is required for use in logging operations where choker cables and the like are often kinked during in-haul. For such field operations, a cable straightener must be portable, must be capable of being quickly set up, and must be durable while also being mechanically simple.

The cable straightener comprises a cable support for supporting a bent portion of cable therebetween, a cable-straightening power jaw mounted by the cable support for movement to and from a position in which it can bear against a bent portion of cable supported by the cable support, and power actuation means mounted by the cable support for causing pivotal movement of the power jaw. The power actuation means may comprise fluid actuation means, and the cable straightener may further comprise control means secured to the cable support for controlling the flow of fluid to such actuation means. Operation of the control means may be accomplished through a knee or leg actuated pedal, thus freeing both of the operator's hands for positioning the cable in the device during a straightening operation.

These and other features, objects and advantages of the invention will be apparent from the detailed description and claims to follow taken in conjunction with the accompanying drawings.

DETAILED DESCRIPTION OF THE DRAWINGS

Figure 1:
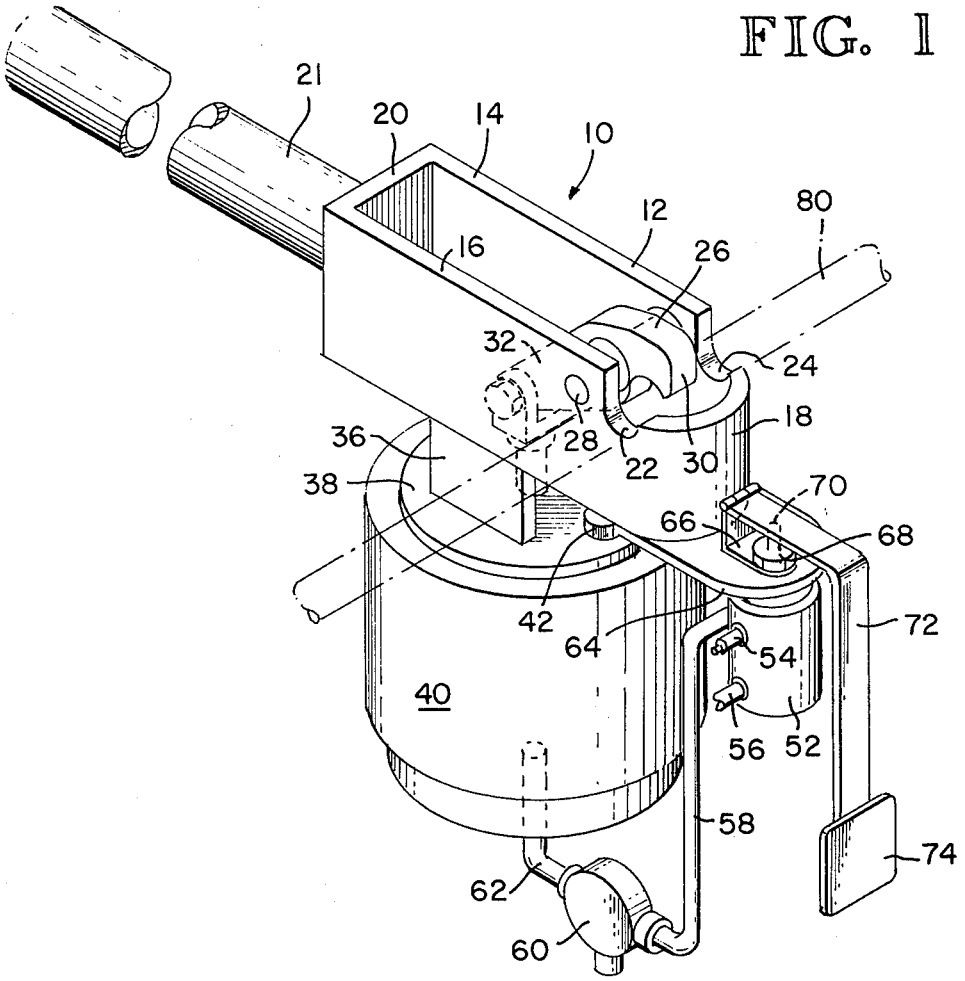
FIG. 1 is a perspective view of a cable straightener according to the present invention.

FIG. 1 depicts a cable straightener device 10 according to the present invention. The device comprises a cable support 12 having laterally spaced, identical parallel arms 14, 16 joined at one end by U-shaped end section 18. The other ends of arms 14, 16 are connected by cross member 20. Tubular support 21 extends horizontally from cross member 20 and may be used for supporting the cable straightener on a vehicle in the field or in the shop. The upper surface of U-shaped end section 18 is at a lower elevation than the upper surfaces of arms 14, 16. The portions of arms 14, 16 immediately adjacent end section 18 are cut out to form grooves 22, 24 for receiving a cable as hereinafter described.

Jaw 26 is journal-mounted on opposite sides at 28 between arms 12, 14. The elevation of the axis of rotation at 28 is approximately equal to that of the upper surface of end section 18. Jaw 26 includes downwardly curved cable engaging beak 30 which extends from point 28 towards end section 18. The lower concave surface of cable engaging beak 30 is positioned above and between grooves 22, 24 in arms 14, 16. Jaw 26 also includes lever arm 32 extending from point 28 in a direction generally opposite to that of cable engaging beak 30.

Vertical support members 34, 36 extend downward from arms 14, 16 respectively and support a horizontal support plate 38. A pneumatic actuator 40 of conventional design is secured to plate 38 by bolts 42 (only one bolt shown). Connecting rod 44 extends upwards from actuator 40 through a central opening in plate 38. The upper portion of connecting rod 44 is threaded and is received in an internally threaded passage in yoke 46 (FIG. 2) and secured therein by locknut 48. Lever arm 32 of jaw 26 is received within the upper portion of yoke 46 and secured thereto by pin 50 passing through openings in the lever arm and yoke. Up and down motion of connecting rod 44 under the control of actuator 40 is therefore transmitted by yoke 46 into pivotal motion of jaw 26 about point 28.

The flow of air to pneumatic actuator 40 is controlled by control valve 52. Valve 52 includes input nipple 54, exhaust port 56 and a connecting port (not shown) in which one end of air hose 58 is received. The other end of air hose 58 is connected to release valve 60, and a second air hose 62 extends from release valve 60 to pneumatic actuator 40. Input nipple 54 is connected to a source of high pressure air (not shown) which may originate from a vehicle to which the cable straightener is mounted.

The upper portion of control valve 52 includes an externally threaded stem (not shown) which passes through openings in plate 64 and angle bracket 66 into nut 68. Plate 64 extends from and is secured to the lower surface of end section 18 of cable support 12. Plunger 70 is supported within and extends upwardly from the control valve stem, and controls the action of the control valve as hereinafter described. Angle bracket 66 pivotally supports one end of right angle arm 62, the other end of arm 62 terminating in plate 74. Plunger 70 is biased by spring means within control valve 52 into an upward position in which it bears against the under surface of right angle arm 72. The actuating arm 72 may be rotated to either side of valve 52 if pressed by loosening lock nut 68.

With no external pressure applied to plate 74 or arm 72, the upward bias of plunger 70 is sufficient to support the weight of arm 70, and the plunger remains in its upward position. In this position, control valve 52 vents air hose 58 into exhaust port 56, and actuator 40 is unpressurized. In this condition, connecting rod 44 assumes a relatively downward position in which jaw 26 is pivoted such that cable engaging beak 30 is positioned upward and away from cable support 12. With the jaw in this position, a cable 80 to be straightened may be positioned in grooves 22, 24 such that its bent portion is pointing upwards and is directly below cable engaging beak 30.

Figure 2:
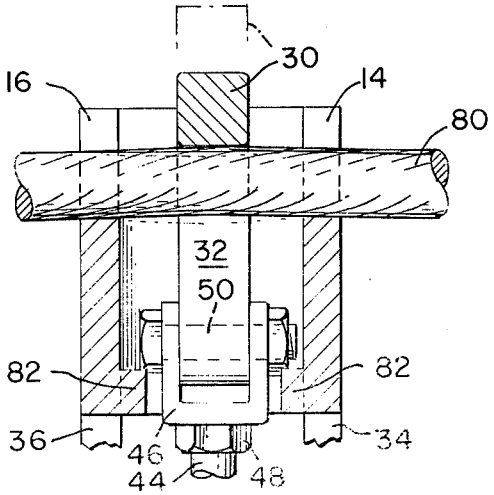
FIG. 2 is a cross sectional view showing the jaw means and cable support means of the FIG. 1 cable straightener.

When a cable 80 has been so positioned, cable straightener 10 may be operated by applying pressure on plate 74 or arm 72 in the direction of actuator 40. Such pressure causes arm 72 to pivot downwards depressing plunger 70, the depression of plunger 70 in turn causing control valve 52 to connect air hose 58 to high pressure air via input nipple 54. The high pressure air flows through air hose 58, release valve 60, and air hose 62 into pneumatic actuator 40. Actuator 40 responds by forcing connecting rod 44 upwards, rotating jaw 26 such that cable engaging beak 30 is driven downwards onto cable 80 (FIG. 2). The downward force of jaw 26 removes the kink or bend in cable 80 and thereby straightens the cable.

Cable engaging beak 30 of jaw 26 remains in its downward position for as long as pressure is maintained on arm 72 or plate 74. When this pressure is removed, the cable straightener returns to its original state described above with cable engaging beak 30 raised. Its return to this state is speeded by release valve 60. As soon as the pressure in air hose 58 drops, release valve 60 vents pneumatic actuator 40 to the atmosphere via air line 62, thus speeding the downward return motion of connecting rod 44.

Figure 3:
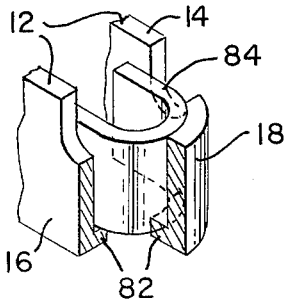
FIG. 3 is a partly broken away perspective view of a cable support insert according to the present invention.

Referring now to FIG. 3, the cable straightener of the present invention may be adapted for straightening cables of different thicknesses by the inclusion of U-shaped inserts 84 in cable support means 12. End section 18 in the adjacent portions of arms 14, 16 are provided with internal shoulders 82 for supporting insert 84. Insert 84 reduces the effective distance between arms 14, 16 and thereby adapts the cable straightener for straightening cables of smaller diameters.

While the preferred embodiment of this invention has been illustrated and described herein, it should be understood that variations will become apparent to one skilled in the art. Accordingly, the invention is not to be limited to the specific embodiment illustrated and described herein and the true scope and spirit of the invention are to be determined by reference to the appended claims.

I claim:

1. A cable straightener comprising:

cable support means including spaced cable receiving members for supporting a hand held bent portion of cable;

jaw means pivotally supported by said cable support means for pivotal movement to and from a position in which it bears against a bent portion of cable supported by said cable receiving members;

power actuation means mounted by said cable support means for causing pivotal movement of the jaw means; and control means mounted on said cable support means for selectively controlling said power actuation means by operator contact while said cable is hand held on said receiving members and including contact means connected thereto for operating said control means by application of body pressure thereto;

whereby straightening force to be applied to a bent portion of cable may be controlled by an operator while the bent portion of cable is hand held.

2. The cable straightener of claim 1 further including cable support adapter means engageable with said cable receiving means for varying the span over which a bent portion of cable is supported, whereby cables of varying diameter and stiffness may be straightened.

3. The cable straightener of claim 2 wherein said cable support adapter means comprises removable insert means engageable with said cable receiving members for supporting a bent portion of cable at locations between said cable receiving members and said jaw means.

4. A cable straightener comprising:

cable support means for supporting a bent portion of cable;

jaw means pivotally supported by said cable support means such that said jaw means is pivotable to and from a position in which it can bear against a bent portion of cable supported by said cable support means;

power actuation means, comprising fluid actuation means, mounted by said cable support means for causing pivotal movement of said jaw means;

control means secured to the cable support means for controlling the flow of fluid to the actuation means including a plunger extending from the upper surface of said control means for operating said control means; and pedal means pivotally connected to and depending from said cable support means in such a way that the pedal means bears against said plunger such that the cable straightener may be operated by applying leg pressure against said pedal means.

5. A cable straightener, comprising:

cable support means including a pair of laterally spaced parallel arms connected by a U-shaped end section, said arms being adapted for supporting a bent section of cable therebetween;

jaw means pivotally supported by said arms such that the jaw means is pivotable to and from a position in which it can bear against a bent portion of cable supported between said arms, the jaw means including a curved cable engaging member extending towards said end section;

fluid actuation means secured to and depending from the cable support means for causing pivotal movement of the jaw means; and control means secured to the cable support means for controlling the flow of fluid to the actuation means.

6. The cable straightener of claim 5, wherein the upper portions of the end sections and of the arms adjacent thereto are cut away such that their upper surfaces are at approximately the same height as the pivot means.

7. The cable straightener of claim 5, further comprising an insert having a shape congruent to the end section and insertable therein, and wherein the end section further comprises shoulder means on its inner surface for supporting the insert, the shoulder means being positioned such that when the insert is supported therein, the upper surfaces of the insert and the end section are of equal height.

8. The cable straightener of claim 7, wherein the control means includes a plunger extending from its upper surface for operating the control means, and wherein the cable straightener further comprises pedal means pivotally connected to and depending from the cable support in such a way that the pedal means bears against said plunger such that the cable straightener may be operated by applying foot pressure against the pedal means.

* * * * *